US007820874B2

(12) United States Patent
Manifold et al.

(10) Patent No.: US 7,820,874 B2
(45) Date of Patent: Oct. 26, 2010

(54) ACACIA FIBER-CONTAINING FIBROUS STRUCTURES AND METHODS FOR MAKING SAME

(75) Inventors: John Allen Manifold, Milan, IN (US); Kenneth Douglas Vinson, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 518 days.

(21) Appl. No.: 11/351,744

(22) Filed: Feb. 10, 2006

(65) Prior Publication Data

US 2007/0187055 A1 Aug. 16, 2007

(51) Int. Cl.
*A61F 13/15* (2006.01)
*B27N 1/00* (2006.01)
*D21F 11/00* (2006.01)

(52) U.S. Cl. ..... 604/367; 604/365; 604/374; 604/375; 162/91; 162/158

(58) Field of Classification Search ..... 604/365, 604/367, 374, 375; 162/91, 158
See application file for complete search history.

(56) References Cited

U.S. PATENT DOCUMENTS

| | | | |
|---|---|---|---|
| 3,301,746 | A | 1/1967 | Sanford et al. |
| 3,473,576 | A | 10/1969 | Amneus |
| 3,573,164 | A | 3/1971 | Friedberg et al. |
| 3,821,068 | A | 6/1974 | Shaw |
| 3,974,025 | A | 8/1976 | Ayers |
| 3,994,771 | A | 11/1976 | Morgan, Jr. et al. |
| 4,166,001 | A | 8/1979 | Dunning et al. |
| 4,191,609 | A | 3/1980 | Trokhan |
| 4,239,065 | A | 12/1980 | Trokhan |
| 4,300,981 | A | 11/1981 | Carstens |
| 4,528,239 | A | 7/1985 | Trokhan |
| 4,637,859 | A | 1/1987 | Trokhan |
| 5,147,505 | A | 9/1992 | Altman |
| 5,397,435 | A | 3/1995 | Ostendorf et al. |
| 5,405,499 | A | 4/1995 | Vinson |
| 5,405,501 | A | 4/1995 | Phan et al. |
| 5,573,637 | A | 11/1996 | Ampulski et al. |

(Continued)

FOREIGN PATENT DOCUMENTS

EP 0613979 A1 2/1994

(Continued)

OTHER PUBLICATIONS

Paperi ja Puu; Paavilainen, Leena. "Quality competiveness of Asian short-fibre raw materials in different paper grades" vol. 82, No. 3 : 156-161, Apr. 2000.

(Continued)

*Primary Examiner*—Jacqueline F. Stephens
(74) *Attorney, Agent, or Firm*—C. Brant Cook

(57) ABSTRACT

Multi-layered fibrous structures comprising hardwood pulp fibers that are present in the outer layers of the fibrous structures at differing weight percents, sanitary tissue products comprising such fibrous structures and methods for making such fibrous structures are provided. More particularly, the present invention relates to multi-layered fibrous structures comprising Acacia fibers that are present in the outer layers of the fibrous structures at differing weight percents, sanitary tissue products comprising such fibrous structures and methods for making such fibrous structures are provided.

20 Claims, 2 Drawing Sheets

U.S. PATENT DOCUMENTS

| | | | | |
|---|---|---|---|---|
| 5,582,685 | A | 12/1996 | Vinson | |
| 5,635,028 | A | 6/1997 | Vinson et al. | |
| H1672 | H | 8/1997 | Hermans et al. | |
| 5,785,813 | A | 7/1998 | Smith et al. | |
| 5,932,068 | A | 8/1999 | Farrington, Jr. et al. | |
| 6,074,527 | A | 6/2000 | Hsu et al. | |
| 6,241,850 | B1 | 6/2001 | Kelly | |
| 6,277,241 | B1 | 8/2001 | Merker et al. | |
| 6,413,363 | B1 | 7/2002 | Hsu et al. | |
| 6,419,790 | B1 | 7/2002 | Leege et al. | |
| 6,468,391 | B1 | 10/2002 | Sharyo et al. | |
| 6,827,819 | B2 | 12/2004 | Dwiggins et al. | |
| 6,896,768 | B2 | 5/2005 | Dwiggins et al. | |
| 7,208,429 | B2 * | 4/2007 | Vinson et al. | 442/143 |
| 2002/0084048 | A1 | 7/2002 | Merker et al. | |
| 2002/0162635 | A1 | 11/2002 | Hsu et al. | |
| 2003/0188841 | A1 | 10/2003 | Buder et al. | |
| 2004/0084167 | A1 | 5/2004 | Vinson et al. | |
| 2004/0163781 | A1 | 8/2004 | Hernandez-Munoa et al. | |
| 2004/0163782 | A1 | 8/2004 | Hernandez-Munoa et al. | |
| 2004/0231812 | A1 * | 11/2004 | Hernandez-Munoa | 162/109 |

FOREIGN PATENT DOCUMENTS

| | | | |
|---|---|---|---|
| EP | 0 806 521 | A2 | 11/1997 |
| EP | 0 806 520 | B1 | 11/2002 |
| WO | WO 97/27363 | | 7/1997 |
| WO | WO 98/23813 | | 6/1998 |
| WO | WO 99/25924 | | 5/1999 |

OTHER PUBLICATIONS

Sample 1—A non-through air dried bath tissue comprising about 34% acacia fibers. (Jun. 2002).

Sample 2—A non-through air dried bath tissue comprising about 54% acacia fibers. (Jun. 2002).

Sample 3—A through air dried bath tissue comprising acacia fibers, but no permanent wet strength resins and no chemical softeners. (Oct. 2000).

Sample 4—A non-through air dried Tempo® handkerchief. (Sep. 2002).

Sample 5—A non-through air dried Tempo® handkerchief (Dec. 2002).

* cited by examiner

ACACIA FIBER-CONTAINING FIBROUS STRUCTURES AND METHODS FOR MAKING SAME

FIELD OF THE INVENTION

The present invention relates to multi-layered fibrous structures comprising hardwood pulp fibers that are present in the outer layers of the fibrous structures at differing weight percents, sanitary tissue products comprising such fibrous structures and methods for making such fibrous structures. More particularly, the present invention relates to multi-layered fibrous structures comprising Acacia fibers that are present in the outer layers of the fibrous structures at differing weight percents, sanitary tissue products comprising such fibrous structures and methods for making such fibrous structures.

BACKGROUND OF THE INVENTION

Fibrous structures, especially fibrous structures used for sanitary tissue products, such as toilet paper, facial tissue and paper towels, oftentimes are formed with multiple layers of different fiber types. For example, some fibrous structures are formed with 100 weight percent of Eucalyptus pulp fibers present in one or more outer layers of the fibrous structures. Eucalyptus pulp fibers, which are hardwood pulp fibers, are known to provide greater consumer recognizable softness than softwood pulp fibers, such as Northern Softwood Kraft and/or Southern Softwood Kraft pulp fibers. However, there is still an unmet need for delivering even greater consumer recognizable softness in fibrous structures than what Eucalyptus pulp fibers can provide.

Accordingly, there exists a need for fibrous structures that comprises pulp fibers in at least one of the outer layers such that the fibrous structures provide greater consumer recognizable softness than what is currently delivered by fibrous structures comprising Eucalyptus pulp fibers in at least one of the outer layers of the fibrous structures.

SUMMARY OF THE INVENTION

The present invention fulfills the need described above by providing a fibrous structure that comprises Acacia pulp fibers in at least one of the outer layers of a fibrous structure, sanitary tissue products comprising such fibrous structures and methods for making such fibrous structures.

In one example of the present invention, a multi-layered fibrous structure comprising: a) a first outer layer; b) a second outer layer; and c) an intermediate layer positioned between the first and second outer layers; wherein a greater weight percent of Acacia fiber is present in the first outer layer than in the second outer layer, is provided.

In another example of the present invention, a sanitary tissue product comprising a fibrous structure according to the present invention is provided.

In yet another example of the present invention, a method for making a fibrous structure, the method comprising the steps of:

a. preparing an embryonic multi-layered fibrous web comprising at least two layers, wherein one of the at least two layers comprises hardwood pulp fibers and wherein the embryonic multi-layered fibrous web comprises Acacia pulp fibers; and b. contacting a cylindrical dryer surface with the layer of the embryonic multi-layered fibrous web that comprises hardwood pulp fibers such that the web is dried to form the fibrous structure.

Accordingly, the present invention provides multi-layered fibrous structures comprising Acacia pulp fibers; sanitary tissue products comprising such fibrous structures and methods for making such fibrous structures.

DETAILED DESCRIPTION OF THE INVENTION

Figure 1:
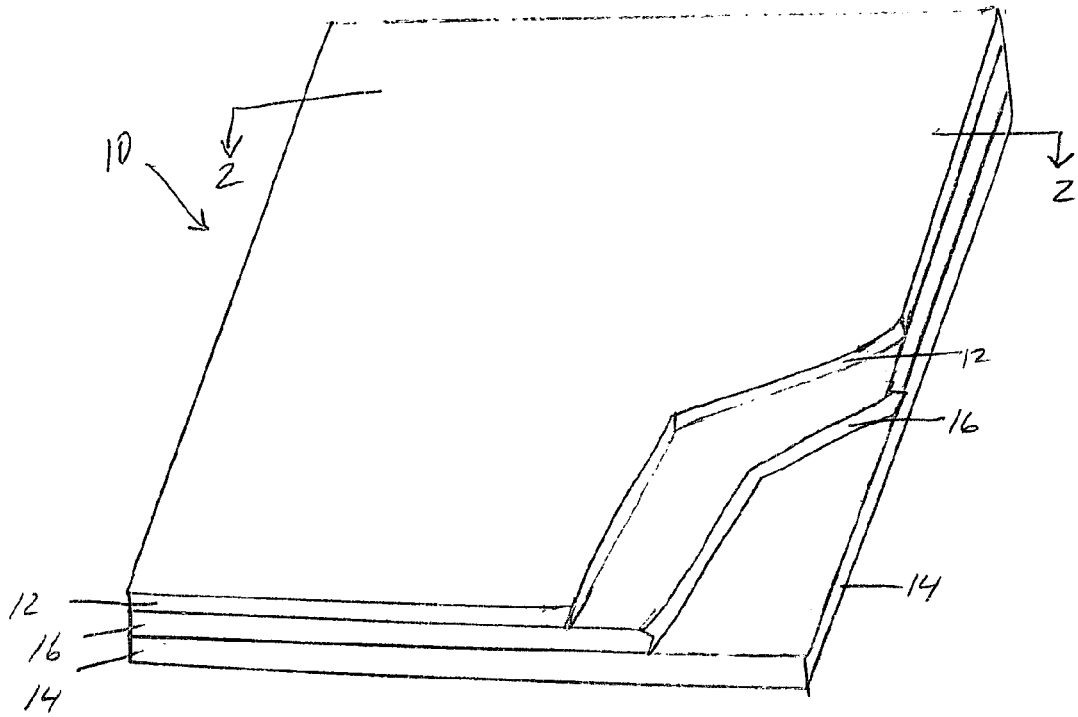
FIG. 1 is a schematic representation of a fibrous structure in accordance with the present invention.

"Fiber" as used herein means an elongate particulate having an apparent length greatly exceeding its apparent width, i.e. a length to diameter ratio of at least about 10. More specifically, as used herein, "fiber" refers to papermaking fibers. The present invention contemplates the use of a variety of papermaking fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, and bagasse can be used in this invention. Synthetic fibers, such as polymeric fibers, can also be used. Elastomeric polymers, polypropylene, polyethylene, polyester, polyolefin, and nylon, can be used. The polymeric fibers can be produced by spunbond processes, meltblown processes, and other suitable methods known in the art.

An embryonic fibrous web can be typically prepared from an aqueous dispersion of papermaking fibers, though dispersions in liquids other than water can be used. The fibers are dispersed in the carrier liquid to have a consistency of from about 0.1 to about 0.3 percent. It is believed that the present invention can also be applicable to moist forming operations where the fibers are dispersed in a carrier liquid to have a consistency of less than about 50% and/or less than about 10%.

"Sanitary tissue product" as used herein means a soft, low density (i.e. <about 0.15 g/cm3) web useful as a wiping implement for post-urinary and post-bowel movement cleaning (toilet tissue), for otorhinolaryngological discharges (facial tissue), and multi-functional absorbent and cleaning uses (absorbent towels).

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a paper product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$).

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or paper product comprising the fibrous structure.

"Total Dry Tensile Strength" or "TDT" of a fibrous structure of the present invention and/or a paper product comprising such fibrous structure is measured as follows. One (1) inch by five (5) inch (2.5 cm×12.7 cm) strips of fibrous structure and/or paper product comprising such fibrous structure are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The TDT is the arithmetic total of MD and CD tensile strengths of the strips.

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$. The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Apparent Density" or "Density" as used herein means the basis weight of a sample divided by the caliper with appropriate conversions incorporated therein. Apparent density used herein has the units $g/cm^3$.

"Softness" of a fibrous structure according to the present invention and/or a paper product comprising such fibrous structure is determined as follows. Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;

2. a grade of plus two is given if X is judged to surely be a little softer than Y, and a grade of minus two is given if Y is judged to surely be a little softer than X;

3. a grade of plus three is given to X if it is judged to be a lot softer than Y, and a grade of minus three is given if Y is judged to be a lot softer than X; and, lastly:

4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

"Layered" as used herein means that a fibrous structure comprises two or more layers of different fiber compositions (long, short, hardwood, softwood, curled/kinked, linear). Layered fibrous structures are well known in the art as exemplified in U.S. Pat. Nos. 3,994,771, 4,300,981 and 4,166,001 and European Patent Publication No. 613 979 A1. Fibers typically being relatively long softwood and relatively short hardwood fibers are used in multi-layered fibrous structure papermaking processes. Multi-layered fibrous structures suitable for the present invention may comprise at least two superposed layers, an inner layer and at least one outer layer contiguous with the inner layer. Preferably, the multi-layered fibrous structures comprise three superposed layers, an inner or center layer, and two outer layers, with the inner layer located between the two outer layers. The two outer layers preferably comprise a primary filamentary constituent of about 60% or more by weight of relatively short papermaking fibers having an average fiber length, L, of less than about 1.5 mm. These short papermaking fibers are typically hardwood fibers, preferably hardwood Kraft fibers, especially Acacia pulp fibers alone or in combination with other hardwood pulp fibers such as Eucalyptus pulp fibers. The inner layer preferably comprises a primary filamentary constituent of about 60% or more by weight of relatively long papermaking fibers having an average fiber length, L, of greater than or equal to about 1.5 mm. These long papermaking fibers are typically softwood fibers, preferably, northern softwood Kraft fibers.

The fiber compositions forming the layers of the fibrous structure may comprise any mixture of fiber types.

The fibrous structures of the present invention may comprise at least two and/or at least three and/or at least four and/or at least five layers.

"Cylindrical drying surface" as used herein means a rotating cylinder with a non-air permeable heat transfer surface to which an incompletely-dried (contains some level of water/moisture, typically above 5% and/or above 7% by weight) fibrous structure is adhered to during a fibrous structure making operation.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Fibrous Structure

The fibrous structures of the present invention may comprise a multi-layered fibrous structure; namely a fibrous structure that comprises two or more layers of different fiber compositions.

In one example, the fibrous structure comprises three or more layers, wherein at least one of the outer layers comprises Acacia pulp fibers. In another example, the fibrous structure comprises three or more layers, wherein the outer layers comprise Acacia pulp fibers. In yet another example, the fibrous structure comprises three or more layers wherein the outer layers comprise Acacia pulp fibers at different weight percents, such that the fibrous structure exhibits biased Acacia pulp fiber presence. In other words, more weight percent of Acacia pulp fiber is present in one outer layer versus the other outer layer. The weight percent difference in Acacia pulp fiber between the two outer layers may be greater than 5% and/or greater than 10% and/or greater than 20% and/or greater than 30% and/or greater than 40% and/or greater than 50% and/or greater than 60%.

In other examples, the fibrous structure may comprise additional pulp fiber types within the outer layers. For example, in addition to the Acacia pulp fiber, the one or more of the outer layers of the fibrous structure may comprise other types of hardwood pulp fibers, such as Eucalyptus pulp fibers. At least one of the outer layers may comprise from 0 to about 100% by weight of the layer of Acacia pulp fiber. At least one of the outer layers may comprise from 0 to about 100% by weight of the layer of a hardwood pulp fiber other than Acacia pulp fiber, such as Eucalyptus pulp fiber. At least one of the outer layers may comprise a greater weight percent of Acacia pulp fiber than any other hardwood pulp fiber present in the outer layer. At least one of the outer layers may comprise greater than 15% and/or greater than 25% and/or greater than 35% and/or 50% and/or greater than 60% and/or greater than 70% and/or greater than 80% by weight of the layer of Acacia pulp fiber and less than 85% and/or less than 75% and/or less than 65% and/or less than 50% and/or less than 40% and/or less than 30% and/or less than 20% by weight of another hardwood pulp fiber, such as Eucalyptus pulp fiber.

In one example, one of the outer layers of the fibrous structure comprises a weight ratio of Acacia pulp fiber to Eucalyptus pulp fiber of greater than 1:1 and/or greater than 1.5:1 and/or greater than 2:1

In another example, one of the outer layers of the fibrous structure comprises a weight ratio of Acacia pulp fiber to Eucalyptus pulp fiber of less than 1:1 and/or less than 1:1.5 and/or less than 1:2.

In one example, it was unexpectedly found that a mixture of Acacia pulp fibers and Eucalyptus pulp fibers in at least one outer layer provided a greater consumer recognizable (consumer noticeable) softness benefit ("softness") than a 100% Eucalyptus pulp fiber outer layer.

Further, in another example, it was unexpectedly found that a 100% Acacia pulp fiber outer layer provided a greater consumer recognizable (consumer noticeable) softness benefit ("softness") than a 100% Eucalyptus pulp fiber outer layer.

In still other examples, the one or more intermediate layers of the fibrous structure (i.e., sandwiched between the outer layers of the fibrous structure), may comprise softwood pulp fibers such as Northern Softwood Kraft pulp fibers and/or Southern Softwood Kraft pulp fibers. The fibrous structure may comprise one, two, three or more intermediate layers.

In yet another example, one of the outer layers of the fibrous structure may be at least 10% more massive than the other outer layer of the fibrous structure.

Figure 2:
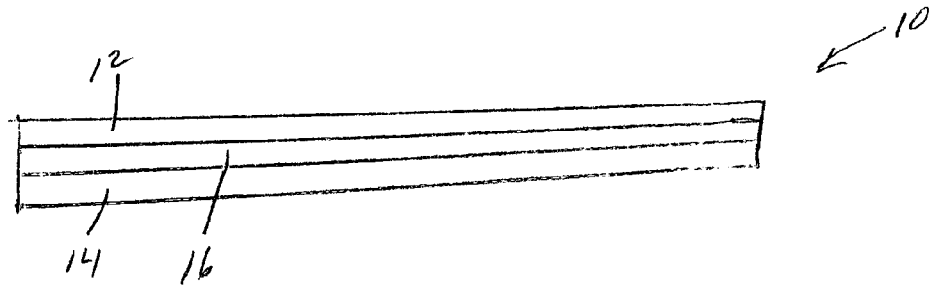
FIG. 2 is a cross-sectional view of FIG. 1 taken along line 2-2.

As shown in FIG. 1, an enlarged schematic representation of a multi-layered fibrous structure 10 in accordance with the present invention comprises outer layers 12, 14 and an intermediate layer 16. The each of the layers comprises a fiber composition that is different from the fiber composition of both of the other two layers. FIG. 2 is a cross-sectional view of the fibrous structure shown in FIG. 1.

The fibrous structure of the present invention may additionally comprise any suitable ingredients known in the art. Nonlimiting examples of suitable ingredients that may be included in the fibrous structures include permanent and/or temporary wet strength resins, dry strength resins, softening agents, wetting agents, lint resisting agents, absorbency-enhancing agents, immobilizing agents, especially in combination with emollient lotion compositions, antiviral agents including organic acids, antibacterial agents, polyol polyesters, antimigration agents, polyhydroxy plasticizers, opacifying agents and mixtures thereof. Such ingredients, when present in the fibrous structure of the present invention, may be present at any level based on the dry weight of the fibrous structure. Typically, such ingredients, when present, may be present at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structure of the present invention may be of any type, including but not limited to, conventionally felt-pressed fibrous structures; pattern densified fibrous structures; and high-bulk, uncompacted fibrous structures. The fibrous structures may be creped or uncreped and/or through-dried or conventionally dried. The sanitary tissue products made therefrom may be of a single-ply or multi-ply construction.

In one embodiment, the fibrous structure of the present invention is a pattern densified fibrous structure characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Processes for making pattern densified fibrous structures are well known in the art as exemplified in U.S. Pat. Nos. 3,301,746, 3,974,025, 4,191,609 and 4,637,859.

In general, pattern densified fibrous structures are preferably prepared by depositing a papermaking furnish on a foraminous forming wire such as a Fourdrinier wire to form a wet fibrous structure and then juxtaposing the fibrous structure against a three-dimensional substrate comprising an array of supports. The fibrous structure is pressed against the three-dimensional substrate, thereby resulting in densified zones in the fibrous structure at the locations geographically corresponding to the points of contact between the array of supports and the wet fibrous structure. The remainder of the fibrous structure not compressed during this operation is referred to as the high-bulk field. This high-bulk field can be further dedensified by application of fluid pressure, such as with a vacuum type device or a blow-through dryer, or by mechanically pressing the fibrous structure against the array of supports of the three-dimensional substrate. The fibrous structure is dewatered, and optionally predried, in such a manner so as to substantially avoid compression of the high-bulk field. This is preferably accomplished by fluid pressure, such as with a vacuum type device or blow-through dryer, or alternately by mechanically pressing the fibrous structure against an array of supports of the three-dimensional substrate wherein the high-bulk field is not compressed. The operations of dewatering, optional predrying and formation of the densified zones may be integrated or partially integrated to reduce the total number of processing steps performed. Subsequent to formation of the densified zones, dewatering, and optional predrying, the fibrous structure is dried to completion, preferably still avoiding mechanical pressing. Preferably, from about 8% to about 65% of the fibrous structure surface comprises densified knuckles, the knuckles preferably having a relative density of at least 125% of the density of the high-bulk field.

The three-dimensional substrate comprising an array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are well known in the art as exemplified in U.S. Pat. Nos. 3,301,746, 3,821,068, 3,974,025, 3,573,164, 3,473,576, 4,239,065 and 4,528,239. In one embodiment, the papermaking furnish is first formed into a wet fibrous structure on a foraminous forming carrier, such as a Fourdrinier wire. The fibrous structure is dewatered and transferred to a three-dimensional substrate (also referred to generally as an "imprinting fabric"). The furnish may alternately be initially deposited on a three-dimensional foraminous supporting carrier. Once formed, the wet fibrous structure is dewatered and, preferably, thermally predried to a selected fiber consistency of between about 40% and about 80%. Dewatering is preferably performed with suction boxes or other vacuum devices or with blow-through dryers. The knuckle imprint of the imprinting fabric is impressed in the fibrous structure as discussed above, prior to drying the fibrous structure to completion. One method for accomplishing this is through application of mechanical pressure. This can be done, for example, by pressing a nip roll which supports the imprinting fabric against the face of a drying drum, such as a Yankee dryer, wherein the fibrous structure is disposed between the nip roll and drying drum. Also, preferably, the fibrous structure is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Typically, it is this drying/imprinting fabric which induces the structure to have differential density, although other methods of patterned densifying are possible and included within the scope of the invention. Differential density structures may comprise a field of low density with discrete high density areas distributed within the field. They may alternately or further comprise a field of high density with discrete low density areas distributed within that field. It is also possible for a differential density pattern to be strictly composed of discrete elements or regions, i.e. elements or regions which are not continuous. Continuous elements or regions are defined as those which extend to terminate at all edges of the periphery of the repeating unit (or useable unit in the event that the pattern does not repeat within such useable unit).

Most commonly, differential density structures comprise two distinct densities; however, three or more densities are possible and included within the scope of this invention. For purposes of this invention, a region is referred to as a "low density region" if it possesses a density less than the mean density of the entire structure. Likewise, a region is referred to as a "high density region" if it possesses a density greater than the mean density of the entire structure.

The fibrous structures of the present invention and/or sanitary tissue products comprising such fibrous structures may have a basis weight of between about 10 $g/m^2$ to about 120 $g/m^2$ and/or from about 14 $g/m^2$ to about 80 $g/m^2$ and/or from about 20 $g/m^2$ to about 60 $g/m^2$.

The fibrous structures of the present invention and/or sanitary tissue products comprising such fibrous structures may have a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structures of the present invention and/or sanitary tissue products comprising such fibrous structures may have a density of about 0.60 g/cc or less and/or about 0.30 g/cc or less and/or from about 0.04 g/cc to about 0.20 g/cc.

Hardwood Pulp Fibers:

Acacia pulp fibers and Eucalyptus pulp fibers are nonlimiting examples of hardwood pulp fibers.

The hardwood pulp fibers of the present invention may have a length of from about 0.4 mm to about 1.2 mm and/or from about 0.5 mm to about 0.75 mm and/or from about 0.6 mm to about 0.7 mm and a coarseness of from about 3.0 mg/100 m to about 7.5 mg/100 m and/or from about 5.0 mg/100 m to about 7.5 mg/100 m and/or from about 6.0 mg/100 m to about 7.0 mg/100 m.

The hardwood pulp fibers of the present invention may be derived from a fiber source selected from the group consisting of Acacia , Eucalyptus, Maple, Oak, Aspen, Birch, Cotton-wood, Alder, Ash, Cherry, Elm, Hickory, Poplar, Gum, Walnut, Locust, Sycamore, Beech, Catalpa, Sassafras, Gmelina, Albizia, Anthocephalus, Magnolia and mixtures thereof.

In one embodiment, the hardwood pulp fibers are derived from tropical hardwood, such as Acacia pulp fibers and/or Eucalyptus pulp fibers.

Nonlimiting examples of suitable hardwood pulp fibers, especially Acacia pulp fibers, which may have lengths of from about 0.4 mm to about 1.2 mm and coarsenesses of from about 3.0 mg/100 m to about 7.5 mg/100 m, are commercially available from PT Tel of Indonesia and/or Riau Andalan. Eucalyptus pulp fibers are commercially available from Aracruz.

The hardwood pulp fibers of the present invention may comprise cellulose and/or hemicellulose. In one example, the fibers comprise cellulose.

The length and coarseness of the hardwood pulp fibers may be determined using a Kajaani FiberLab Fiber Analyzer commercially available from Metso Automation, Kajaani Finland. As used herein, fiber length is defined as the "length weighted average fiber length". The instructions supplied with the unit detail the formula used to arrive at this average. However, the recommended method used to determine fiber lengths and coarseness of fiber specimens essentially the same as detailed by the manufacturer of the Fiber Lab. The recommended consistencies for charging to the Fiber Lab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, the length and coarseness of the hardwood pulp fibers may be determined by sending the hardwood pulp fibers to an outside contract lab, such as Integrated Paper Services, Appleton, Wis.

Method for Making Fibrous Structure

Figure 3:
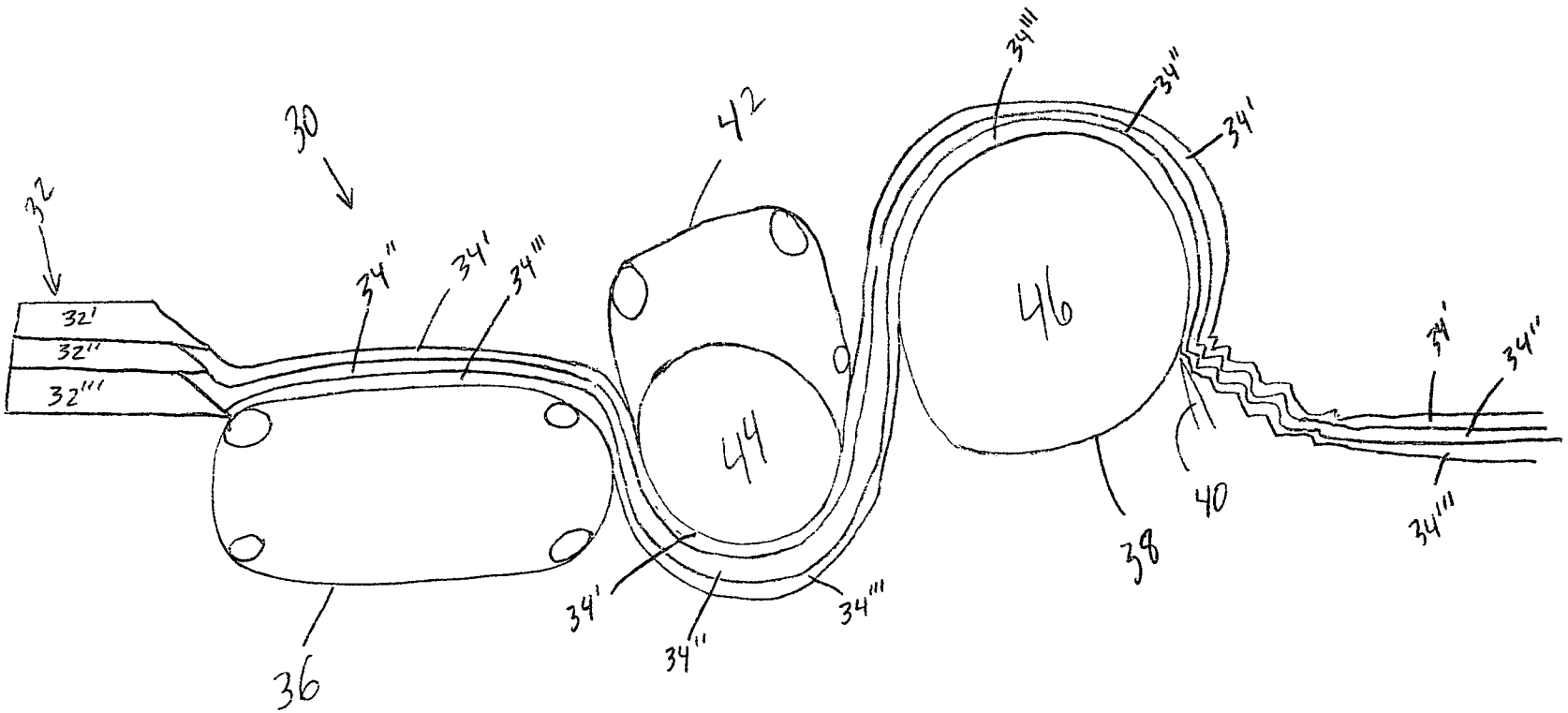
FIG. 3 is a schematic representation illustrating an example of a method for making a fibrous structure in accordance with the present invention.

As shown in FIG. 3, a nonlimiting example of a method 30 for making a fibrous structure in accordance with the present invention is schematically represented. A suitable method utilizes a multi-chambered headbox 32. The headbox 32 comprises at least two chambers, in this case three chambers 32', 32" and 32'". Chambers 32' and 32'" may comprise the same or different fiber compositions. If a two-layered fibrous structure is made using headbox 32, then the fiber compositions in 32' and 32" or 32" and 32'" are the same. In this example, all three chambers 32', 32" and 32'" all comprise different fiber compositions. Chamber 32' comprises Acacia pulp fiber. It may also comprise additional types of hardwood pulp fiber, such as Eucalyptus pulp fibers. Chamber 32" comprises softwood pulp fiber. Chamber 32'" comprises hardwood pulp fiber. If chamber 32'" comprises Acacia pulp fiber, then it comprises less Acacia pulp fiber by weight percent than the Acacia pulp fiber present in Chamber 32'. From the headbox 32, three layers 34', 34" and 34'" of different fiber compositions are deposited onto a Foraminous fourdinier wire 36. Chamber 32' produces layer 34'. Chamber 32" produces layer 34". Chamber 32'" produces layer 34'". Layers 34' and 34'" are the outer layers of the fibrous structure that will be produced during the fibrous structure making operation. Layer 34' may comprise a greater weight percent of Acacia pulp fiber than layer 34'". As shown in FIG. 3, layer 34'" directly contact the foraminous fourdinier wire 36 during formation. Fibrous structure progresses, it is clear that layer 34'" also contacts and/or becomes adhered to cylindrical drying surface 38 from which the fibrous structure may be creped via a doctor blade 40.

During the fibrous structure making operation, layer 34' may contact a drying fabric 42, such as during a through-dried step. Layer 34' may ride upon the drying fabric 42 as the drying fabric 42 moves around a through-dryer 44. In one example, layer 34' may be sandwiched between the through-dryer 44 and the drying fabric 42. As shown in FIG. 3, layer 34' does not contact a cylindrical drying surface, such as cylindrical drying surface 38, during formation of the fibrous structure. The cylindrical drying surface 38 may be part of a Yankee dryer 46.

In alternative examples of the present invention, the outer layer comprising the greatest weight percent of Acacia pulp fiber may contact a cylindrical drying surface during the fibrous structure making operation.

In another example of the present invention, the outer layer comprising the greatest weight percent of Acacia pulp fiber may not contact a drying fabric during the fibrous structure making operation.

Even though FIG. 3 shows a nonlimiting example of a through-dried fibrous structure making operation, the fibrous structures of the present invention may be formed by conventionally pressed fibrous structure making operations and/or uncreped through-dried fibrous structure making operations.

NONLIMITING EXAMPLES

Example 1

Any suitable process for making fibrous structures known in the art may be used to make the Acacia fiber-containing fibrous structures of the present invention.

The following Example illustrates a nonlimiting example for a preparation of a sanitary tissue product comprising a fibrous structure according to the present invention on a pilot-scale Fourdrinier fibrous structure making machine.

An aqueous slurry of Acacia (Riau Andalan Indonesian bleached kraft pulp) pulp fibers and Eucalyptus (Aracruz Brazilian bleached kraft pulp) pulp fibers is prepared at about 3% fiber by weight using a conventional repulper. The pulps are proportioned such that about 50% of the mass of fibers is Acacia and about 50% is Eucalyptus. This slurry is passed through a stock pipe toward a multi-layered, three-chambered headbox of a Fourdrinier wet laid papermaking machine.

Separately, an aqueous slurry of Eucalyptus fibers is prepared at about 3% by weight using a conventional repulper. This slurry is passed through a stock pipe toward the multi-layered, three-chambered headbox of a Fourdrinier wet laid papermaking machine.

Finally, an aqueous slurry of NSK (Northern Softwood Kraft) fibers of about 3% by weight is made up using a conventional repulper. This slurry is passed through a stock pipe toward the multi-layered, three-chambered headbox of a Fourdrinier wet laid papermaking machine.

In order to impart temporary wet strength to the finished fibrous structure, a 1% dispersion of temporary wet strengthening additive (e.g., Parez® 750) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The NSK, acacia/eucalyptus, and eucalyptus fiber slurries are diluted with white water at the inlet of their respective fan pumps to consistencies of about 0.15% based on the total weight of the respective slurries. The three slurries are spread over the width of the Fourdrinier, but maintained as separate streams in the multichambered headbox until they are deposited onto a forming wire on the Fourdrinier.

The fibrous structure making machine has a layered headbox having a top chamber, a center chamber, and a bottom chamber. The eucalyptus/acacia combined fiber slurry is pumped through the top headbox chamber, the eucalyptus fiber slurry is pumped through the bottom headbox chamber (i.e. the chamber feeding directly onto the forming wire) and, finally, the NSK fiber slurry is pumped through the center headbox chamber and delivered in superposed relation onto the Fourdrinier wire to form thereon a three-layer embryonic web, of which about 50% is made up of the eucalyptus/acacia blended fibers, 20% is made of the eucalyptus fibers and 30% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 12 mils above the supporting fabric. A suitable process for making the patterned drying fabric is described in published application US 2004/0084167 A1.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 656 feet per minute. The fibrous structure may be subsequently converted into a two-ply sanitary tissue product having a basis weight of about 50 g/m$^2$. For each ply, the outer layer having the combined eucalyptus/acacia fiber furnish is oriented toward the outside in order to form the consumer facing surfaces of the two-ply sanitary tissue product.

The sanitary tissue paper product is very soft and absorbent.

Example 2

To further illustrate the invention, a so-called uncreped throughdried tissue is produced using the papermaking device as illustrated in FIG. 1 of U.S. Pat. No. 5,932,068. More specifically, a three-layered, single-ply bath tissue in which one of the outer layers comprises eucalyptus fibers and the other of the outer layers comprises a blend of eucalyptus and acacia fibers and a center layer comprises northern softwood kraft fibers is produced.

An aqueous slurry of acacia (Riau Andalan Indonesian bleached kraft pulp) fibers and eucalyptus (Aracruz Brazilian bleached kraft pulp) fibers is prepared at about 3% fiber by weight using a conventional repulper. The pulps are proportioned such that about 50% of the mass of fibers is acacia and about 50% is eucalyptus. This slurry is passed through a stock pipe toward the multi-layered, three-chambered headbox of a twin wire wet laid papermaking machine.

Separately, an aqueous slurry of eucalyptus fibers is prepared at about 3% by weight using a conventional repulper. This slurry is passed through a stock pipe toward the multi-layered, three-chambered headbox of a twin wire wet laid papermaking machine.

Finally, an aqueous slurry of NSK fibers of about 3% by weight is made up using a conventional repulper. This slurry is passed through a stock pipe toward the multi-layered, three-chambered headbox of a twin wire wet laid papermaking machine.

In order to impart temporary wet strength to the finished fibrous structure, a 1% dispersion of temporary wet strengthening additive (e.g., Parez® 750) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The NSK, acacia/eucalyptus, and eucalyptus fiber slurries are diluted with white water at the inlet of their respective fan pumps to consistencies of about 0.15% based on the total weight of the respective slurries. The three slurries are spread over the width of the twin wire papermaking machine, but maintained as separate streams in the multichambered headbox until they are discharged into the forming zone of the twin wire machine.

The fibrous structure making machine has a layered headbox having a first outer layer chamber, a center chamber, and a second outer layer chamber. The eucalyptus/acacia combined fiber slurry is pumped through the first outer layer headbox chamber, the eucalyptus fiber slurry is pumped through the second outer layer headbox chamber (i.e. the chamber feeding directly onto the forming wire adjacent to the suction forming roll of the twin wire machine) and, finally, the NSK fiber slurry is pumped through the center headbox chamber and delivered in superposed relation onto the Fourdrinier wire to form thereon a three-layer embryonic web, of which about 50% is made up of the eucalyptus/acacia blended fibers, 20% is made of the eucalyptus fibers and 30% is made up of the NSK fibers. Dewatering occurs through the Fourdrinier wire and is assisted by a deflector and vacuum boxes. The wire on the suction forming roll side of the twin wire machine is an Asten 856A while the backing wire is an Asten 866 The newly-formed web is then dewatered to a consistency of about 20-27% using vacuum suction from below the forming fabric before being transferred to a transfer fabric (Asten 934) at about 25% rush transfer.

The web is then transferred to a throughdrying fabric traveling at about the same speed as the transfer fabric. An Asten 934 throughdrying fabrics is acceptable for use in this position. The web is carried over a Honeycomb throughdryer and dried to a final dryness of about 94-98% consistency.

The fibrous structure may be conveyed to a roll and subsequently converted into a two-ply sanitary tissue product having a basis weight of about 50 g/m$^2$. For each ply, the outer layer having the combined eucalyptus/acacia fiber furnish is oriented toward the outside in order to form the consumer facing surfaces of the two-ply sanitary tissue product.

The sanitary tissue paper product is very soft and absorbent.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-layered fibrous structure comprising three or more layers including:

a. a first outer layer;

b. a second outer layer;

c. an intermediate layer positioned between the first and second outer layers;

wherein a greater weight percent of Acacia fiber is present in the first outer layer than in the second outer layer and wherein all of the layers comprises different fiber compositions from the other layers.

2. The fibrous structure according to claim 1 wherein the first outer layer did not contact a cylindrical drying surface during formation.

3. The fibrous structure according to claim 1 wherein the first outer layer contacts a drying fabric.

4. The fibrous structure according to claim 3 wherein the drying fabric comprises a patterned fabric.

5. The fibrous structure according to claim 1 wherein the second outer layer contacted a foraminous wire during formation.

6. The fibrous structure according to claim 1 wherein the second outer layer contacted a cylindrical dryer during formation.

7. The fibrous structure according to claim 1 wherein at least one of the first and second outer layers comprises other hardwood fiber.

8. The fibrous structure according to claim 7 wherein the other hardwood fiber comprises Eucalyptus fiber.

9. The fibrous structure according to claim 1 wherein the intermediate layer comprises softwood fiber.

10. The fibrous structure according to claim 9 wherein the softwood fiber comprises Northern Softwood Kraft fiber.

11. The fibrous structure according to claim 1 wherein the first outer layer is at least 10% more massive than the second outer layer.

12. The fibrous structure according to claim 1 wherein the first outer layer comprises at least 15% by weight of Acacia pulp fiber.

13. The fibrous structure according to claim 1 wherein the first outer layer comprises at least 35% by weight of Acacia pulp fiber.

14. The fibrous structure according to claim 1 wherein the first outer layer comprises at least 50% by weight of Acacia pulp fiber.

15. The fibrous structure according to claim 1 wherein the first outer layer comprises about 100% by weight of Acacia pulp fiber.

16. The fibrous structure according to claim 1 wherein the first outer layer comprises a weight ratio of Acacia pulp fiber to Eucalyptus pulp fiber of greater than 1:1.

17. The fibrous structure according to claim 1 wherein the second outer layer comprises a weight ratio of Acacia pulp fiber to Eucalyptus pulp fiber of less than 1:1.

18. A sanitary tissue product comprising a fibrous structure according to claim 1 wherein the sanitary tissue product comprises a user contacting surface comprising Acacia fiber.

19. A method for making a fibrous structure, the method comprising the steps of:

a. preparing an embryonic multi-layered fibrous web comprising three or more layers, wherein the embryonic multi-layered fibrous web comprises a first outer layer comprising Acacia pulp fibers and a second outer layer, wherein a greater weight percent of Acacia fiber is present in the first outer layer than in the second outer layer wherein all of the layers comprise different fiber compositions from the other layers; and b. contacting a cylindrical dryer surface with the second outer layer of the embryonic multi-layered fibrous web such that the web is dried to form the fibrous structure.

20. A fibrous structure made by the method according to claim 19.

* * * * *